US005639304A

United States Patent [19]

Hoffman

[11] Patent Number: 5,639,304

[45] Date of Patent: Jun. 17, 1997

[54] DEVICE FOR APPLYING A COATING TO A SOLID MEDICAMENT

[76] Inventor: Paul D. Hoffman, 3776 Old Kings Hwy. - Rte. 6A, Brewster, Mass. 02631

[21] Appl. No.: 386,067

[22] Filed: Feb. 9, 1995

[51] Int. Cl.[6] ..... B05C 3/02

[52] U.S. Cl. ..... 118/407; 118/423; 118/30; 118/26; 424/474

[58] Field of Search ..... 118/407, 423, 118/400, 26, 30, 22, 408; 74/89.17; 424/474; 134/135–137, 143, 150, 157

[56] References Cited

U.S. PATENT DOCUMENTS 719,896 2/1903 Spang .
3,327,682 6/1967 Garay .
4,660,881 4/1987 Komeya et al. .

FOREIGN PATENT DOCUMENTS 2113249 7/1994 Canada .
1219166 3/1986 U.S.S.R. .

*Primary Examiner*—Donald E. Czaja
*Assistant Examiner*—Calvin Padgett
*Attorney, Agent, or Firm*—Lahive & Cockfield

[57] ABSTRACT

A device and method for applying a coating material to a solid medicament. The device comprises a reservoir which contains the coating material, and a platform mounted with an actuator above the reservoir for holding the medicament. The medicament is placed in the platform, which is moved into and out of the coating material in the reservoir upon depression and release of the actuator.

6 Claims, 3 Drawing Sheets

DEVICE FOR APPLYING A COATING TO A SOLID MEDICAMENT

This invention relates to devices and methods for applying a coating to a solid medicament which is administered to a patient to be ingested internally.

BACKGROUND OF THE INVENTION

Medicaments are routinely prescribed for and administered to patients for a wide variety of physiological conditions. The term "medicament", as used herein, means any therapeutic substance, consumable or nonconsumable, which is intended for intake by humans or animals. Solid medicaments, such as pills or tablets, are consumable and can generally be orally ingested. The term "solid", as used herein, means any material, the physical, chemical or biological properties of which do not appreciably change upon contact of the solid with the coating materials outlined herein.

Solid medicaments which must be administered orally or internally are frequently relatively large and potentially difficult or uncomfortable to ingest or administer. Further, a relatively complex course of treatment may require the administration of numerous solid medicaments of several types and sizes on a daily basis or even more frequently. The administration of a solid medicament should be safe, painless and convenient for the patient, to ensure completion of the treatment regime with optimum therapeutic results. For example, solid medicaments such as pills or tablets should ideally be of a size and shape that promotes their ingestion, with an outer surface that is smooth or otherwise easily swallowed. Alternatively, some solid medicaments can be formulated with palatable ingredients to render them chewable and thus easier to ingest.

However, many solid medicaments cannot be made small and innocuous and therefore are relatively difficult to administer, especially to patients who may be incapable of self-administration of the medicament, such as infants, the seriously ill or injured, and the elderly. It would thus be advantageous to have a device and/or a method for assisting in the administration of solid medicaments which are potentially difficult to ingest or administer.

It is therefore an object of the invention to provide methods and devices for facilitating the administration of solid medicaments to patients.

SUMMARY OF THE INVENTION

Accordingly, the invention provides a device for applying a coating to a solid medicament prior to its administration to a patient. In one embodiment of the invention, the device comprises a reservoir which contains the coating material. The device further includes a platform which is mounted above the level of the coating material in the reservoir and movable into and out of the reservoir. The platform is mounted with an actuator which moves the platform into and out of the reservoir in response to pressure applied to the actuator.

In a preferred embodiment the platform is a perforated tray which can be flat or bowl-shaped to contain the medicament thereon.

The actuator includes an actuator head which can be depressed to move the platform into the reservoir and released to lift the platform out of the reservoir. The actuator may include, for example, a flexible spring or resilient element which permits movement of the platform into and out of the reservoir in response to pressure on the actuator. In a preferred embodiment, the spring or resilient element is disposed between the platform and the bottom of the reservoir.

According to another aspect of the invention, there is provided a method of applying a coating to a solid medicament. The method comprises the steps of providing a device as described above and at least partially filling the reservoir with a desired coating material. A solid medicament to be coated is placed on the platform, and the actuator is depressed to lower the platform bearing the solid medicament into the reservoir containing the coating material so as to submerge the solid medicament in the coating material. The actuator is then released to permit the platform and the solid medicament thereon to rise out of the coating material in the reservoir. The coated medicament can then be removed from the platform.

The solid medicament can be a consumable oral medication, such as a pill or tablet.

These and other features of the invention will be more fully appreciated with reference to the following detailed description which is to be read in conjunction with the attached drawings.

DETAILED DESCRIPTION OF THE INVENTION

The invention is a device and method for applying a coating, such as a lubricant, to a solid medicament, such as a pill, tablet, which is to be administered to a patient. The device and method are simple in design and construction and can be conveniently used, for example, by the patient or by one administering the medicament to the patient.

Figure 1:
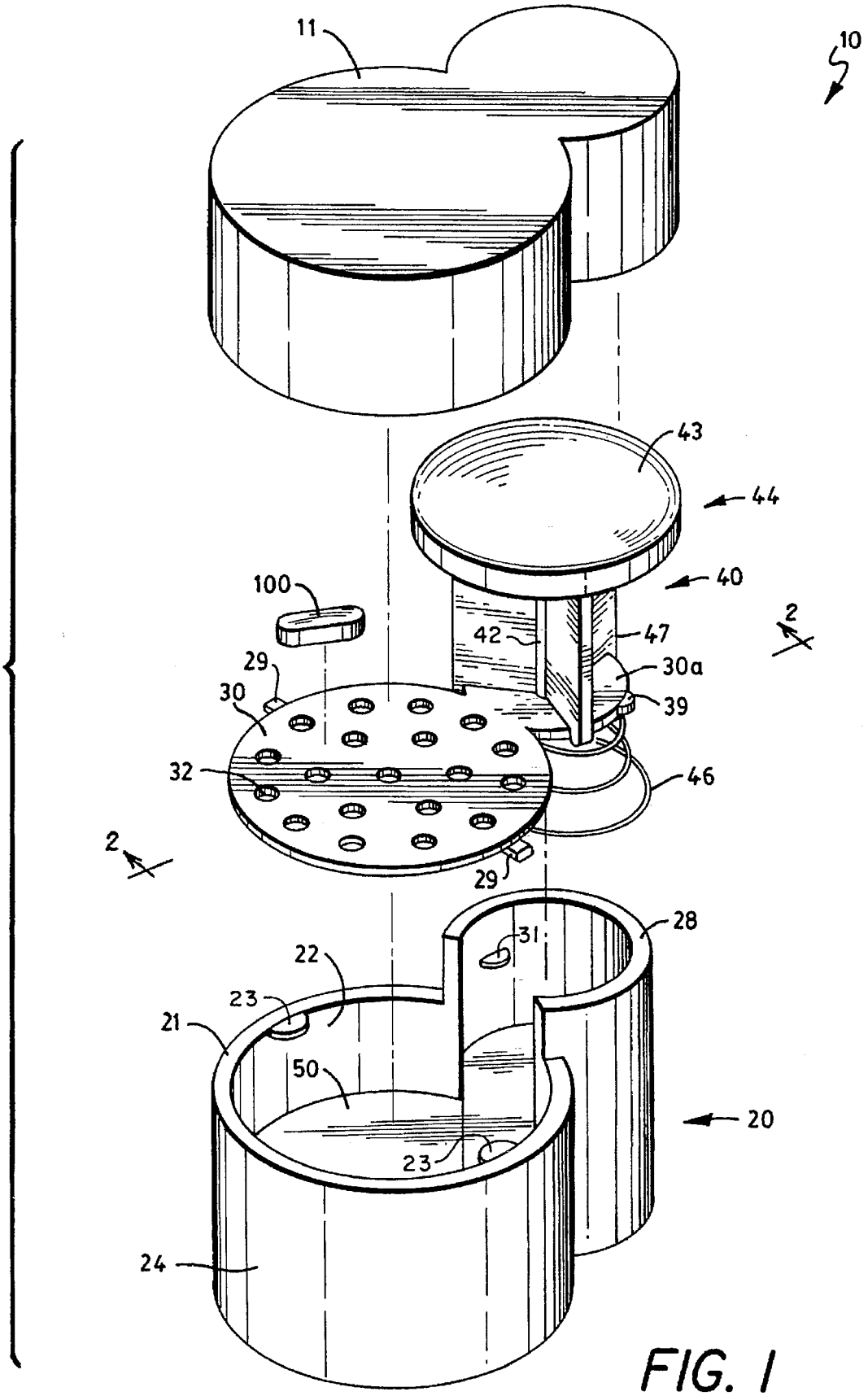
FIG. 1 is an exploded perspective view of a device according to the invention.

FIG. 1 shows a device 10 for applying a coating material 50 to a solid medicament 100. The device 10 includes a reservoir 20 which can be of any convenient size and shape with walls 24 and interior cavity 22 for containment of the coating material 50. The device 10 further includes a platform 30 which is of a size and shape that fits within the interior cavity 22 of the reservoir with sufficient clearance for unrestricted movement into and out of the cavity. The platform 30 is mounted with an actuator 40 which causes the platform to be movable into and out of the interior cavity 22 of the reservoir in response to pressure on the actuator 40.

The reservoir 20 can be equipped with a removable cover 11 to keep the reservoir and the coating material in the reservoir from being contaminated by airborne dusts and the like when the device is not is use. The cover 11 is designed to fit over the top of the reservoir 20 and the actuator 40.

The actuator 40 is located in a housing 28 within the reservoir 20. The housing 28 partially surrounds the actuator and preferably has the same general outline or contour as the actuator, the housing being slightly larger than the actuator so that the actuator is movable longitudinally in the housing without restriction.

The platform 30 can be solid in construction or, preferably, perforated with small holes or slits 32 to permit passage of the coating material 50 therethrough, thereby reducing drag of the platform through the coating material and facilitating the movement of the platform into and out of the coating material 50 in the reservoir 20. The platform 30 can be constructed, for example, as a flat plate or a concave bowl or other convenient shape. The platform preferably has the same general outline or profile as the reservoir, the reservoir being slightly larger to provide a clearance between the edges of the platform and the inner walls of the reservoir. Such a clearance permits the platform to move more easily into and out of the coating material in the reservoir without bringing up excessive liquid coating material and causing the coating material to spill over the sides of the reservoir when the platform is raised out of the reservoir. In order to insure that the platform stays centered in the larger cavity 22 the platform 30 is formed with tabs 29 mounted on the underneath surface of the platform to maintain the platform 30 centered. The tabs 29 project below the platform 30 leaving a clearance space between the floor of reservoir 24 and the platform 30. The reservoir 20 includes protruding stops 23 which upon contact with tabs 29 prevent the platform from rising above the rim 21 of the reservoir 24.

The actuator 40 comprises a shaft 42 which extends partially into a portion of the housing 28 in the reservoir 20. The shaft 42 is preferably joined to or integrally formed with the platform 30, with a portion of the shaft extending above the platform to form an actuator head 44 which is depressed by the user to move the platform into and out of the reservoir.

Figure 2:
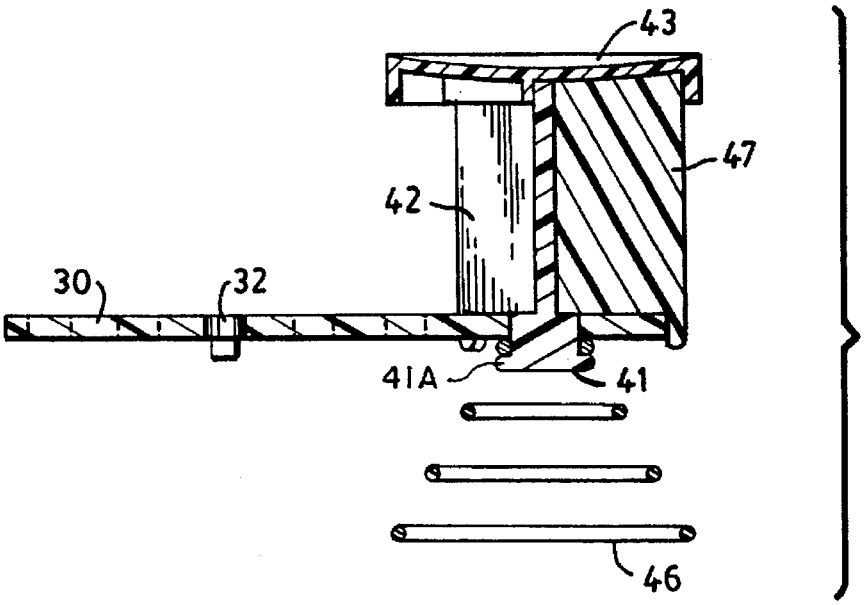
FIG. 2 is a sectional view of the device showing details of the actuator and platform.
Figure 3:
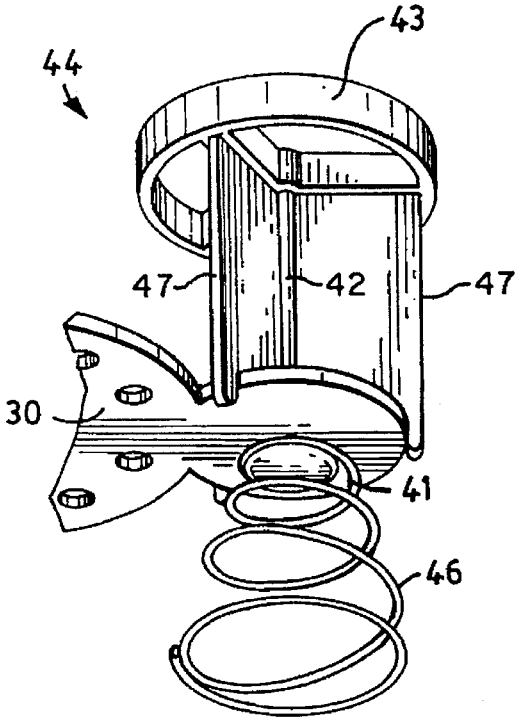
FIG. 3 is a perspective view of an actuator and platform assembly.

As shown in FIGS. 1, 2 and 3 the actuator can include, for example, a spring 46 or other resilient material which can be compressed in response to pressure on actuator 40 to cause the platform 30 to descend into the coating material 50 in the reservoir 20. The spring 46 is preferably a conical compression spring having a maximum diameter which is less than the diameter of the housing 28. The spring 46 engages at its narrow end with a cylindrical protrusion 41 extending downwardly from the bottom of the shaft 42. The protrusion 41 preferably has a slight outward taper so that the coil at the narrow end of the spring 46 engages the nub 41 in a snap fit and is retained thereby. Alternatively, the protrusion 41 may be formed with nub 41 a to retain the spring 46. The wide end of the spring 46 is free and compresses against the floor of the reservoir. The spring 46, shaft 42 and platform 30 thus form an assembly which can be conveniently removed from the reservoir 20 and housing 28 in one piece.

As illustrated in FIGS. 1 through 4*c*, the shaft 42 is formed as a solid post by the junction of three radially extending vanes 47. The combined length of the shaft 42 and the spring 46 in its relaxed state must be such that depression of the actuator head 44 against the spring 46 permits the platform 30 to be lowered sufficiently into the reservoir to coat the solid medicament 100 with the coating material 50. The shaft includes three radially extending vanes 47 which assist in centering the shaft 42 within the housing 28. The vanes can have a uniform-width profile, as shown in FIG. 1, or they can have a nonuniform-width profile with a maximum width at the bottom end of the shaft and a minimum width at the top end of the shaft, shown illustratively in FIGS. 3 and 4 as a tapered profile. The nonuniform-width vane construction is preferred to reduce the amount of coating material brought up with the shaft when the platform 30 is raised from the coating material in the reservoir 20.

The housing 28 is preferably constructed of a rigid, inert, inexpensive material which can be easily fabricated, such as by molding or by machining. The walls 24 of the reservoir can be rigid or relatively flexible.

Figure 4A:
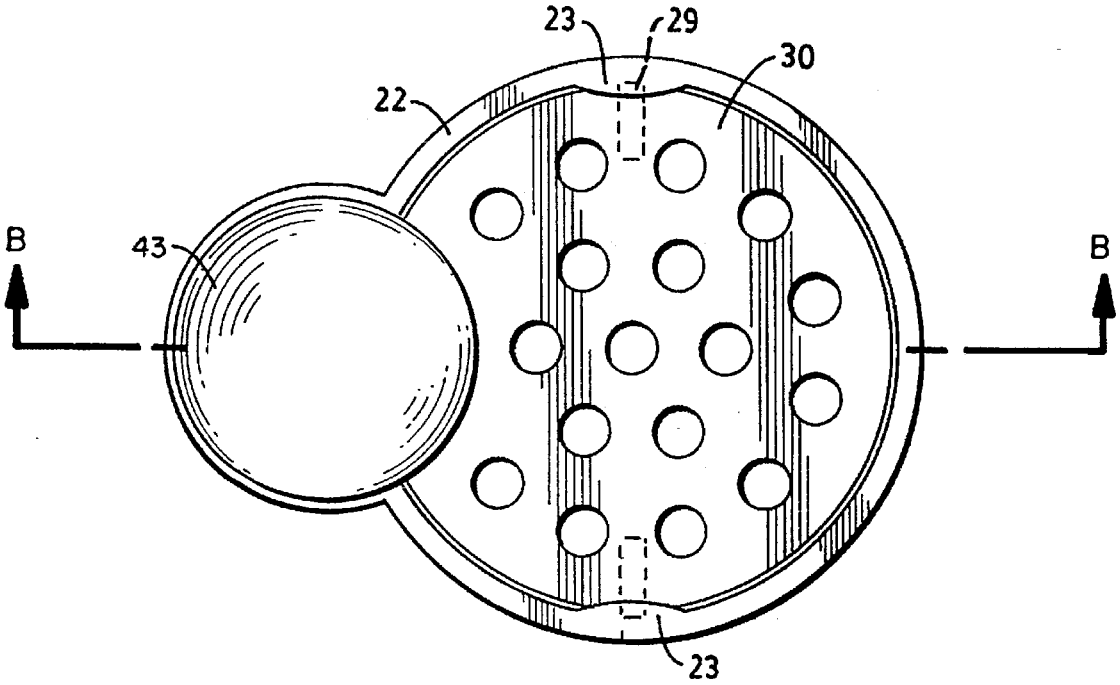
FIGS. 4A and 4B are a top view and a sectional view respectively of the assembled device.
Figure 4B:
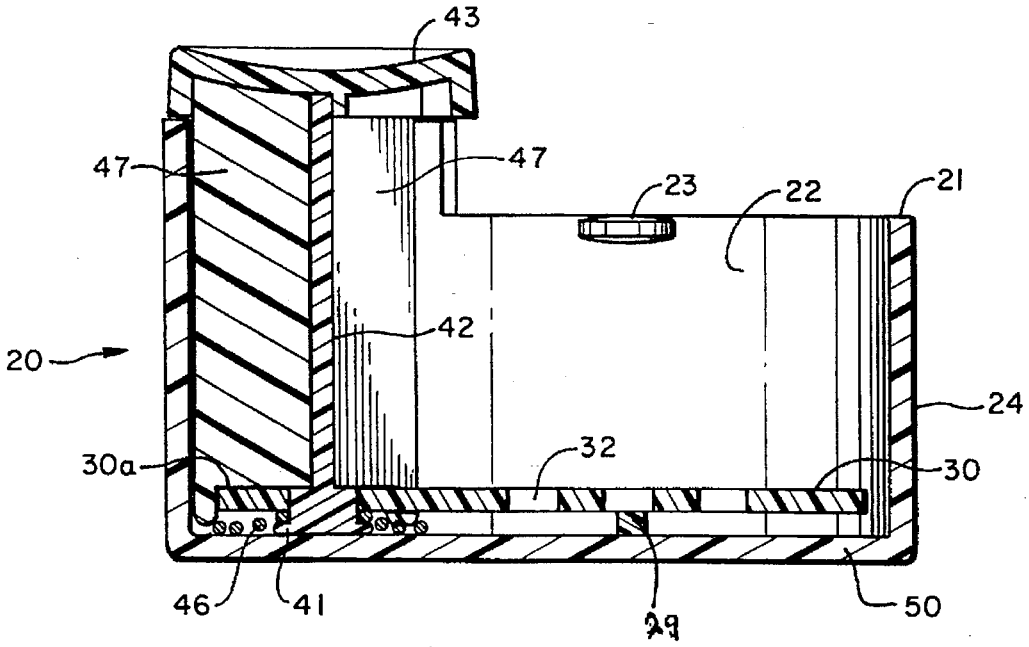

As illustrated particularly in FIGS. 4*a*, 4*b* and 4*c*, the actuator head 44 preferably comprises a cap 43 which fits over an end of the shaft 42. The cap 43 has an outer diameter which is substantially larger than the shaft diameter, for greater accessibility. The cap 43 is preferably permanently attached to, or integrally formed with, the shaft 42 and vanes 47 as by plastic molding or suitable adhesive.

The reservoir 20, platform 30 and actuator 40 and related parts of the device are preferably formed of a rigid, durable, inexpensive, inert and nontoxic material which can be easily fabricated and cleaned and which does not deteriorate upon contact with the selected coating material or impart any undesirable odor, taste or texture either to the medicament or to the coating material. Preferred materials include, but are not limited to, polymeric materials, such as acrylonitrile-butadiene-styrene (ABS) materials. The spring 46 is preferably made of stainless steel. In an alternative embodiment the extension 30*a* of the platform may be formed with coplanar tabs 39 to interact with tabs 31 to limit vertical travel.

The coating material 50 can be any desired nontoxic lubricating material which can be applied to a solid medicament without reacting with the medicament. Suitable coating materials for an oral medication could include, for example, light vegetable. Other coating materials suitable for the application are known in the art and are not further detailed herein.

The device is preferably of a size which is convenient for individuals to use. It should be sufficiently small so that it can be easily stored or left on a counter or shelf when not in use. It should be portable, as well as easy to clean. The reservoir should be sufficiently deep to hold at least an inch of coating material. A typical device thus might measure, for example, one to two inches in height, length and width. The actuator head should be enlarged, easily visible and accessible, and perhaps colored for identification. The stroke of the actuator (i.e., the difference in the length of the spring 46 when compressed and when relaxed) in a device of this size should be approximately an inch so that movement of the actuator is sufficient to submerge the platform in the coating material in the reservoir. The clearance space between the platform edges and the inner walls of the reservoir should be approximately 1/16 inch.

The device 10 can be operated as follows: a desired coating material 50 is added to the interior cavity 22 of the reservoir 20 to fill it partially. Ideally, a sufficient quantity of the coating material 50 should be used to permit complete submergence of the platform 30 and the solid medicaments 100 thereon in the coating material 50 without causing the coating material to overflow the reservoir. A solid medicament 100 to be administered is then placed on the platform 30. The actuator 40 is then depressed by application of suitable pressure to the actuator head 44 to compress spring 46 between the platform and the reservoir floor, thereby lowering the platform 30 and the solid medicament 100 thereon into the coating material 50 in the reservoir 20. The actuator 40 remains depressed until the solid medicament 100 is submerged in or at least substantially covered by the coating material 50. The actuator is then released to raise the platform carrying the coated medicament out of the reservoir. It is preferred to use an instrument, such as a tweezer or similar device (not shown), to remove the coated medicament promptly from the platform so as to remove as little of the coating as possible from the coated medicament while avoiding possible dissolution of the medicament in the coating material. The coated medicament can then be administered using methods known in the art.

An additional advantage of the present invention is the elimination of the initial unpleasant aftertaste in the mouth which can be associated with certain pills and other solid medicaments which do not have a coating. Use of the invention coats the pill with a lubricating, neutral-tasting coating which counteracts the typically bitter or harsh taste of an uncoated pill.

The present invention thus has utility in the administration of a virtually unlimited variety of solid medicaments to humans and animals.

Other alterations to the above-described embodiments will be readily apparent to those of ordinary skill in the art and are intended to be embraced within the spirit and scope of the invention. That is, the above description is intended to be illustrative rather than limiting. The invention is to be defined, therefore, not by the preceding description but by the claims that follow.

I claim:

1. A device for applying a coating to a solid medicament, comprising a housing formed in two horizontally interconnected sections, said first section including a reservoir formed by the housing wall enclosing an interior cavity in said housing having an open top, said second section forming an actuator housing enclosing a generally cylindrical hollow volume, said hollow volume being connected to said reservoir through a vertical opening in said housing wall, an actuator mounted in said actuator housing, said actuator being formed of a shaft adapted for vertical travel within said actuator housing, said shaft having a cap fixed at the upper end thereof and a spring at the lower end thereof, such that downward force placed on said cap provides for downward travel of said shaft, compressing said spring, and release of said downward pressure allows said spring to urge said actuator back to its original position, a generally planar horizontally positioned platform having an outer perimeter conformed to the inner shape of said reservoir and rigidly attached to said actuator shaft through said vertical opening, said platform having perforations therein, the outer perimeter of said platform having a dimension slightly smaller than the inner perimeter of said reservoir to provide clearance for said platform to move freely vertically within said reservoir, said platform being mounted at a vertical position on said actuator shaft such that when said actuator is in its upper position, said platform is near the opening at the top of said reservoir and when said actuator has downward force applied to it said platform is lowered into said reservoir.

2. A device according to claim 1 wherein said actuator comprises a shaft having a plurality of radially extending vanes, a cap disposed At a top end of the shaft and engageable with said vanes, and a spring disposed at a bottom end of the shaft and engageable with a portion of said shaft.

3. A device according to claim 2 wherein said radially extending vanes on said shaft extend vertically substantially the length of said shaft and have a maximum width at a bottom end of the shaft and a minimum width at a top end of the shaft.

4. A device according to claim 1 wherein said reservoir and said platform are formed of a polymeric material.

5. A device according to claim 1 wherein said platform is formed with tabs extending radially therefrom to maintain said platform horizontally centered within said reservoir.

6. A device according to claim 5 wherein said reservoir is formed with stops extending from said housing wall into said interior cavity for engaging said tabs to limit upward vertical movement of said platform within said reservoir.

* * * * *